United States Patent [19]

Grabe

[11] 4,284,136

[45] Aug. 18, 1981

[54] POSITIONING DEFLECTION WEDGES

[75] Inventor: Johan G. Grabe, Carletonville, South Africa

[73] Assignee: Boart International Limited, Johannesburg, South Africa

[21] Appl. No.: 79,259

[22] Filed: Sep. 27, 1979

[30] Foreign Application Priority Data

Feb. 15, 1979 [ZA] South Africa ..... 78/0917

[51] Int. Cl.[3] ..... E21B 7/06; E21B 23/04; E21B 29/06

[52] U.S. Cl. ..... 166/117.5; 166/72; 166/319

[58] Field of Search ..... 166/117.5, 117.6, 319, 166/325, 72, 250, 255; 175/73–76

[56] References Cited

U.S. PATENT DOCUMENTS

| | | | |
|---|---|---|---|
| 2,632,630 | 3/1953 | Storm | 166/117.5 |
| 2,691,507 | 10/1954 | Brown | 166/117.5 |
| 2,953,350 | 9/1960 | Moore | 166/117.5 X |
| 3,000,440 | 9/1961 | Malcomb | 166/117.5 X |
| 3,215,204 | 11/1965 | Sims | 166/117.5 |

FOREIGN PATENT DOCUMENTS

| | | | |
|---|---|---|---|
| 258978 | 4/1970 | U.S.S.R. | 166/117.6 |

*Primary Examiner*—Stephen J. Novosad
*Attorney, Agent, or Firm*—Cushman, Darby & Cushman

[57] ABSTRACT

A deflection wedge is positioned in a long horizontal drill hole by securing it with a shear pin to an extension on a drill string. The extension is turned independently of the drill string to enable a droparm mechanism to actuate a trigger which stops rotation at a predetermined orientation. Rotation is effected by means of a piston-operated rifle bar mechanism. The piston is actuated by passing drilling fluid down the drill string. The trigger causes a valve to be closed to lock the piston hydraulically in position and thus prevent further rotation. The wedge is now secured by axial pressure on the drill string.

5 Claims, 4 Drawing Figures

100
101
102
103
104
105
106
107
108
109
110
111
112
113
114
115
116
117
41
3
4

POSITIONING DEFLECTION WEDGES

BACKGROUND OF THE INVENTION

This invention relates to the positioning of deflection wedges in drill holes which are horizontal or have a pronounced horizontal component.

Deflection wedges for vertical holes are well known and consist essentially of frusto-conical segments which are wedged in position in a drill hole. When next a drill bit is inserted in the hole, the wedge causes the bit to drill at an angle to the axis of the original hole. Deflection wedges are normally positioned at the end of a drill string, let down the hole, orientated to give the correct deflection and then severed from the drill string as by shearing a shear pin. The drill string is then removed leaving the wedge in position—see U.S. Pat. No. 2,950,900.

Devices suitable for deflecting vertical holes cannot be used without change in deflecting horizontal holes. Nowadays horizontal or near horizontal holes are used extensively in very deep mining for exploration.

In South Africa a device has been used on a small scale and with success in holes up to 500 m long. Beyond that length problems are encountered. Basically the mechanism relies on a weighted droparm the free end of which follows a cam. When as a result of rotation of the string the cam attains a position where there is a vertical cam path, the droparm falls and releases a trigger.

The trigger closes a valve which stops water flow through the drill string and causes a hydraulic pulse which can be detected at the drilling machine. This pulse indicates that the cam has attained the correct position, and as the wedge is orientated relatively to the cam, that the wedge is in the correct position. By pushing the drill string forward, the wedge is wedged in position and a pin is sheared to allow withdrawal of the drill string.

When the hole is near horizontal, the drill string rests on the bottom wall of the hole and is subject to a large amount of friction when one turns it to get the correct orientation. When the drill string is very long, the friction results in a wind-up of the drill string and the resulting stored energy when released causes the free end of the string, i.e. the orientation mechanism and wedge, to whip. This energy may be released as the drill string is pushed forward to secure the wedge and shear the pin with the result that the wedge loses its original correct orientation. Also if the droparm falls during the release of energy the wedge may continue to rotate after the hydraulic pulse, indicating correct orientation, has been transmitted to the drilling machine.

In a co-pending application Eilers et al (U.S. Ser. No. 12,904 filed Feb. 16, 1979) have proposed a method of positioning a deflection wedge in a horizontal drill hole comprising the steps of:

- passing the deflection wedge along the hole at the end of a drill string; when the deflection wedge is at the bottom of a hole, turning it relatively to the drill string until it reaches the correct orientation in the drill hole; then preventing further turning;
- wedging the deflection wedge in position by pressing axially on the drill string; and
- detaching the drill string from the deflection wedge by further pressure on the drill string.

The apparatus proposed by them for causing rotation of the deflection wedge includes a mechanism not unlike a spiral ratchet screwdriver which relies on anchoring of spikes at the end of a translation bar at the bottom of a drill hole. In very hard rock it is often difficult to obtain a sufficient anchoring force.

The present invention provides a device which does not rely on anchoring at the bottom of a hole to ensure independent rotation of the deflection wedge.

SUMMARY OF THE INVENTION

According to the invention means for positioning a deflection wedge in a drill hole, which has a pronounced horizontal component of direction, comprises:

- an extension composed of two parts, the first part being a cylinder adapted to be secured to the drill string and in communication with the axial cavity of the drill string, and the second part being free to rotate relatively to the cylinder;
- a deflection wedge detachably carried by the second part;
- a piston reciprocable in the cylinder between first and second positions and exposed to fluid flowing down the drill string to cause it to move towards the second position;
- a spring biasing the piston to its first position;
- rotation means operable by the piston to cause the second part to rotate relatively to the cylinder when the piston moves towards its second position; and
- a wedge orientation mechanism carried by the second part of the extension adapted to stop rotation of the second part of the extension upon a preset orientation of the deflection wedge being achieved.

The means may also comprise a flow path between the cylinder and the end of the second part into the hole being deflected;

- a restrictive orifice between the cylinder and the second part;
- a valve in the flow path;
- a trigger holding the valve in its open position and adapted to be operated by the wedge orientation mechanism to allow closure of the valve by fluid flowing in the path.

DESCRIPTION OF A PREFERRED EMBODIMENT

Figures 1, 2, 3, 4:
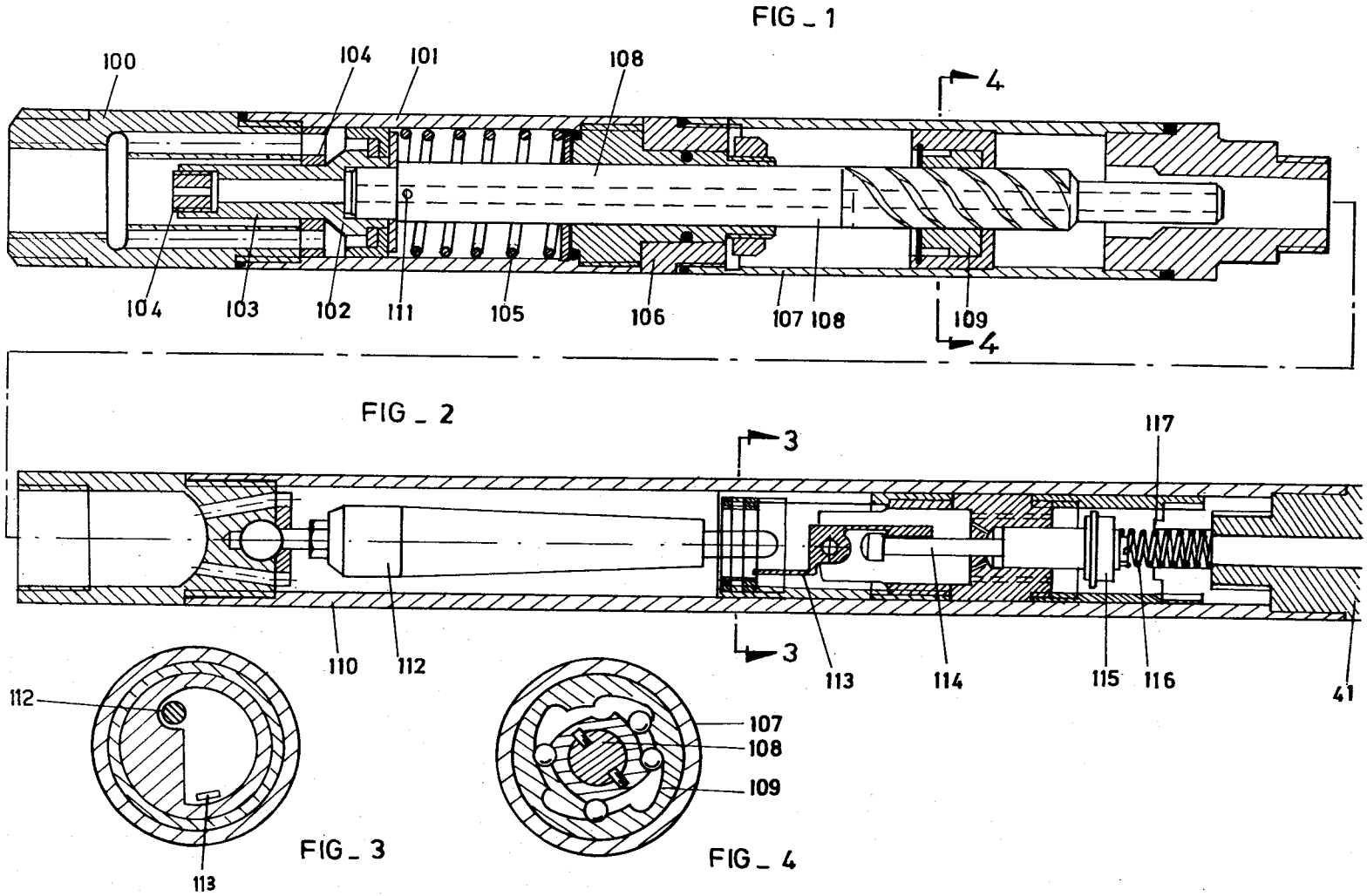
FIGS. 1 and 2 are sections through an embodiment of the invention.
FIG. 3 is a section on the line 3—3 of FIG. 2.
FIG. 4 is a section on the line 4—4 in FIG. 1.

In FIGS. 1 and 2 the extension provided by the invention has been shown in successive sections that fit end to end at the end of a drill string. This is followed by a deflection wedge (not shown) identical to the one disclosed in the abovementioned application by Eilers et al.

First there is a coupling 100 adapted to be screwed to the end of a drill string. The coupling 100 is followed by a cylinder 101. Inside the cylinder 101 there is a piston 102 from which projects a hollow rod 103 which is square shaped and passes through a complemental hole in a spider 104. The spider 104 allows fluid coming down the drill string to pass freely to the piston 102. At the free end of the rod 103 there is a restrictive orifice 118. The piston 102 is biased to the left by means of a spring 105. The cylinder 101 ends in a rotary coupling 106 which carries a sleeve 107. By virtue of the coupling 106 the sleeve 107 can rotate relatively to the cylinder 101.

Also secured to the piston 102 and extending to the right is a hollow translation bar 108. It passes through a nut 109 where two pins engage in the double helix of the bar 108. The nut 109 is held against rotation relatively to the sleeve 107 in one direction only by means of a ratchet (not shown). When the bar 108 moves axially to the right, the nut 109 is held against such rotation. On the return stroke of the bar 108 the nut 109 rotates in the sleeve 107. A bleed hole 111 equalizes pressure to both sides of the piston 103 at low rates of flow.

The sleeve 107 is in turn coupled to a droparm sleeve 110 which carries a droparm 112. The free end of the droparm 112 is engaged with a cam shaped as shown in FIG. 3. In the drop path of the droparm 112 there is a trigger 113 engaged with a shoulder on the stem 114 of a valve 115. The valve 115 is biased to the left by means of a spring 116 and thus into engagement with the trigger 113. In the illustrated position fluid can flow to the right past the valve 115. When the trigger 113 is released and the fluid flow rate is increased the valve 115 is caused to move to the right until it seats on a seat 117.

To the right of the droparm sleeve 110 is secured a coupling 41 as in the embodiment disclosed by Eilers et al and that coupling carries the deflection wedge and so on as before.

With the parts as illustrated drilling fluid coming down the drill string can flow through the orifice 118, down the bar 108, past the droparm 112, past the valve 115, down to the bottom of a drill hole and up past the drill string again. However, as the rate of flow is increased there is a pressure build-up behind the piston 102 and it moves to the right. In the result the translation bar causes turning of the sleeve 107 and all parts to the right of it. At the correct orientation, the arm 112 releases the trigger 113. The fluid pressure now causes the valve 115 to close on its seat 117. A "water-lock" is now created to the left of the valve 115 as all joints to the left are sealed against leakage. The deflection wedge may now be positioned by axial pressure on the drill string as described with reference to the first embodiment.

In operation the whole assembly at the end of a drill string is pushed along a hole until the deflection wedge is just short of the bottom. The drilling fluid pressure is now increased and if the mechanism is set, i.e. the valve 115 is open, there will be a through flow of fluid. If there is no fluid flow, the pressure is lowered sufficiently for the valve resetting spring 116 to open the valve 115.

Even if the valve 115 is open, it may not be held by the trigger 113 if the droparm 112 is resting on the trigger 113. To remedy this the drill string is turned against the ratchet of the nut 109 so that the whole assembly is rotated. This will lift the droparm 112 of the trigger 113 and the valve 115 will be reset. Drilling fluid at low pressure will flow at a low rate through the system.

The pressure is now increased to increase the rate of flow of the drilling fluid. Eventually the pressure of the spring 105 will be overcome and the piston 102 will move to the right and cause the sleeve 107 to turn. At the correct point, the droparm 112 will fall on the trigger 113 to release the valve 115, which under the prevailing pressure will close immediately.

There can now be no more flow and the pressure indication on surface gives an indication that the orientation mechanism has been operated and that the wedge is in the desired position. Axial pressure is now applied to the drill string.

Should it be apparent that the mechanism has not operated correctly, it can be reset in position before applying the axial pressure and this may be done as many times as may be required.

I claim:

1. Means for positioning a deflection wedge in a drill hole, which has a pronounced horizontal component of direction, comprising: an extension composed of two parts, the first part being a cylinder adapted to be secured to the drill string and in communication with the axial cavity of the drill string, and the second part being free to rotate relatively to the cylinder;

a deflection wedge detachably carried by the second part;

a piston reciprocable in the cylinder between first and second positions and exposed to fluid flowing down the drill string to cause it to move towards the second position;

a spring biasing the piston to its first position;

rotation means operable by the piston to cause the second part to rotate relatively to the cylinder when the piston moves towards its second position;

a wedge orientation mechanism carried by the second part of the extension adapted to stop rotation of the second part of the extension upon a preset orientation of the deflection wedge being achieved;

a flow path between the cylinder and the end of the second part into the hole being deflected;

a restrictive orifice between the cylinder and the second part; a valve in the flow path; and a trigger holding the valve in its open position and adapted to be operated by the wedge orientation mechanism to allow closure of the valve by fluid flowing in the path.

2. The positioning means claimed in claim 1 in which the piston actuates a rifle bar mechanism one portion of which is carried by the piston and the other by the second part.

3. The positioning means claimed in claim 1 in which the piston has a rifle bar extending from it and cooperating with a rifle nut secured on the second part.

4. The positioning means claimed in claim 3 in which the rifle nut is held against rotation in one direction only by the second part.

5. The positioning means claimed in claim 4 in which the rifle nut is held by a ratchet mechanism.

* * * * *